US007062787B1

(12) United States Patent
Shircliff

(10) Patent No.: US 7,062,787 B1
(45) Date of Patent: Jun. 20, 2006

(54) KNEEPAD ASSEMBLY

(76) Inventor: David E. Shircliff, 7601 Michael Dr., Louisville, KY (US) 40228

( * ) Notice: Subject to any disclaimer, the term of this patent is extended or adjusted under 35 U.S.C. 154(b) by 0 days.

(21) Appl. No.: 10/434,728

(22) Filed: May 9, 2003

Related U.S. Application Data

(63) Continuation-in-part of application No. 10/108,050, filed on Mar. 28, 2002, now Pat. No. 6,807,682.

(51) Int. Cl.
*A41D 13/00* (2006.01)

(52) U.S. Cl. ..... 2/24

(58) Field of Classification Search ..... 2/24, 2/23, 16, 267, 62, 455, 911; 602/23, 26, 602/62
See application file for complete search history.

(56) References Cited

U.S. PATENT DOCUMENTS

| | | | | | |
|---|---|---|---|---|---|
| 1,055,040 | A * | 3/1913 | Herron et al. | ..... | 2/24 |
| 1,372,790 | A * | 3/1921 | Van Fleet | ..... | 2/24 |
| 2,759,189 | A * | 8/1956 | Cole | ..... | 2/24 |
| 3,112,812 | A * | 12/1963 | Ramon | ..... | 182/230 |
| 3,411,222 | A * | 11/1968 | Williams | ..... | 434/255 |
| 4,287,885 | A * | 9/1981 | Applegate | ..... | 602/26 |
| 5,031,240 | A * | 7/1991 | Nierhaus | ..... | 2/24 |
| 5,090,055 | A * | 2/1992 | McElroy | ..... | 2/24 |
| 5,524,292 | A * | 6/1996 | Hargens | ..... | 2/24 |
| 5,870,774 | A * | 2/1999 | Legenstein | ..... | 2/24 |
| 6,584,616 | B1 * | 7/2003 | Godshaw et al. | ..... | 2/24 |

* cited by examiner

*Primary Examiner*—Tejash Patel
(74) *Attorney, Agent, or Firm*—Berenato, White & Stavish, LLC

(57) ABSTRACT

A knee pad assembly for protecting a knee of a worker installing tile, wood floors, etc. The knee pad assembly includes an outer knee pad structure and a resilient foam inner knee and shin pad structure.

12 Claims, 6 Drawing Sheets

KNEEPAD ASSEMBLY

CROSS-REFERENCE TO RELATED APPLICATIONS

This application is a Continuation-In-Part of U.S. patent application Ser. No. 10/108,050, filed Mar. 28, 2002, now U.S. Pat. No. 6,807,682, the disclosures of which are incorporated herein by reference and priority to which is claimed pursuant to 35 U.S.C. §120.

TECHNICAL FIELD

The present invention relates to workmen's equipment and more particularly to a knee pad assembly for protecting the knee of a worker that includes an outer knee pad structure and a resilient foam inner knee and shin pad structure; the outer knee pad structure being molded of plastic and including a bottom knee support plate having a non-slip bottom surface and a top portion integrally formed with a knee and shin receiving structure that defines an inner knee and shin pad receiving channel; the inner knee and shin pad receiving channel being partially defined by a bottom channel surface of the knee and shin receiving structure and includes a pad protrusion receiving cavity formed therein; the resilient foam inner knee and shin pad structure being shaped to seat into the inner knee and shin pad receiving channel and having a pad protrusion extending from a bottom surface thereof adapted to seat into the pad protrusion receiving cavity of the outer knee pad structure.

BACKGROUND OF INVENTION

Many individuals who work installing tile, wood flooring, etc. have to spend a considerable amount of time on one or more knees in order to accomplish the work. This constant weight on the knees can lead to knee pain as well as knee injury. It would be a benefit to these individuals to have one or more knee pad assemblies that could be attached, respectively, to one or more knees as needed for providing cushioning to their knees as well as reducing the wear and tear on their knees.

GENERAL SUMMARY DISCUSSION OF INVENTION

It is thus an object of the invention to provide a kneepad assembly that includes an outer knee pad structure and a resilient foam inner knee and shin pad structure; the outer knee pad structure being molded of plastic and including a bottom knee support plate having a non-slip bottom surface and a top portion integrally formed with a knee and shin receiving structure that defines an inner knee and shin pad receiving channel; the inner knee and shin pad receiving channel being partially defined by a bottom channel surface of the knee and shin receiving structure and includes a pad protrusion receiving cavity formed therein; the resilient foam inner knee and shin pad structure being shaped to seat into the inner knee and shin pad receiving channel and having a pad protrusion extending from a bottom surface thereof adapted to seat into the pad protrusion receiving cavity of the outer knee pad structure.

Accordingly, a kneepad assembly is provided. The kneepad assembly includes an outer knee pad structure and a resilient foam inner knee and shin pad structure; the outer knee pad structure being molded of plastic and including a bottom knee support plate having a non-slip bottom surface and a top portion integrally formed with a knee and shin receiving structure that defines an inner knee and shin pad receiving channel; the inner knee and shin pad receiving channel being partially defined by a bottom channel surface of the knee and shin receiving structure and includes a pad protrusion receiving cavity formed therein; the resilient foam inner knee and shin pad structure being shaped to seat into the inner knee and shin pad receiving channel and having a pad protrusion extending from a bottom surface thereof adapted to seat into the pad protrusion receiving cavity of the outer knee pad structure.

Also provided is a knee pad assembly featuring a knee pad outer structure and a resilient knee pad inner structure. The knee pad outer structure has a first side with a non-skid surface, and a second side with a central cavity and first and second concentric cavities encircling the central cavity. The resilient knee pad inner structure features a protrusion positioned in the central cavity so that applying pressure to the knee pad assembly causes the protrusion within the central cavity to absorb the pressure. The first concentric cavity is subdivided into at least four chambers, and the second concentric cavity is undivided and surrounds the first concentric cavity.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

FIGS. 1–12 show various aspects of an exemplary embodiment of the kneepad assembly of the present invention generally designated 10. Kneepad assembly knee pad system 10 includes a molded plastic, outer knee pad structure, generally designated 12 and a resilient, molded foam inner knee and shin pad structure, generally designated 14.

Figure 1:
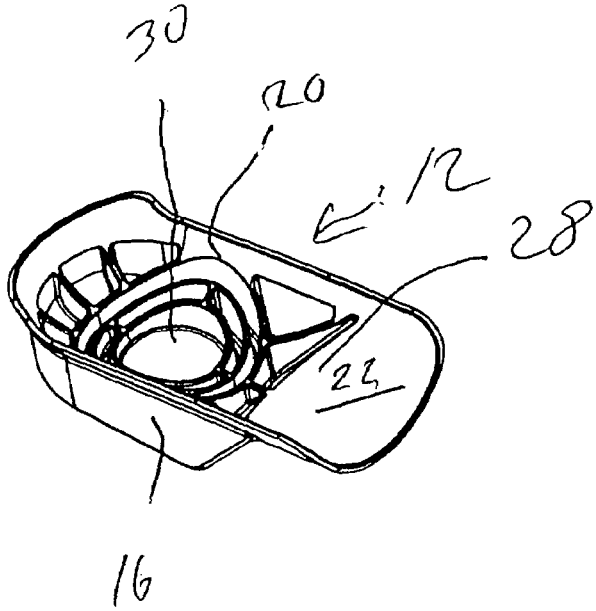
FIG. 1 is a perspective view of an exemplary embodiment of the outer knee pad structure of an exemplary embodiment of the knee pad assembly of the present invention.
Figure 2:
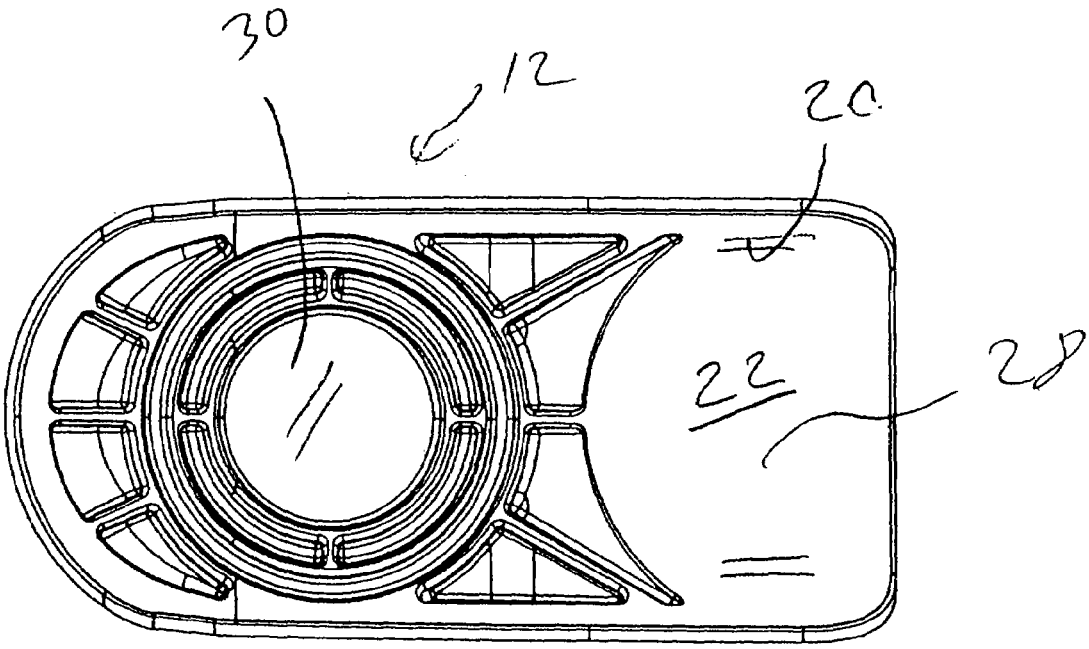
FIG. 2 is a top plan view of the exemplary embodiment of the outer knee pad structure of FIG. 1.
Figure 3:
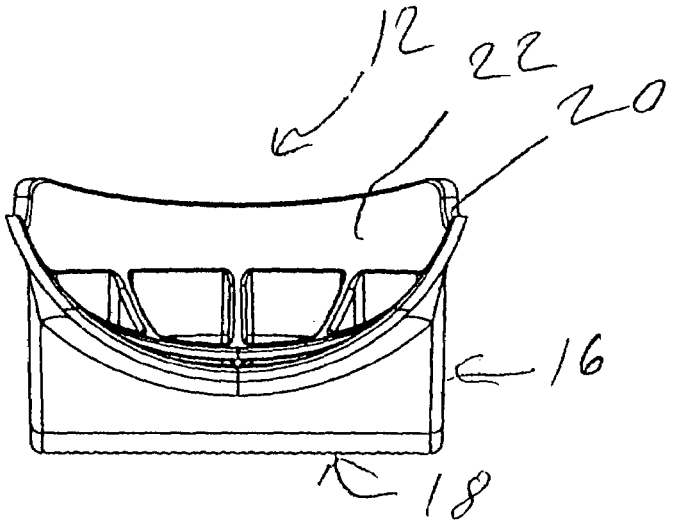
FIG. 3 is a rear end, plan view of the outer knee pad structure of FIG. 1.
Figure 4:
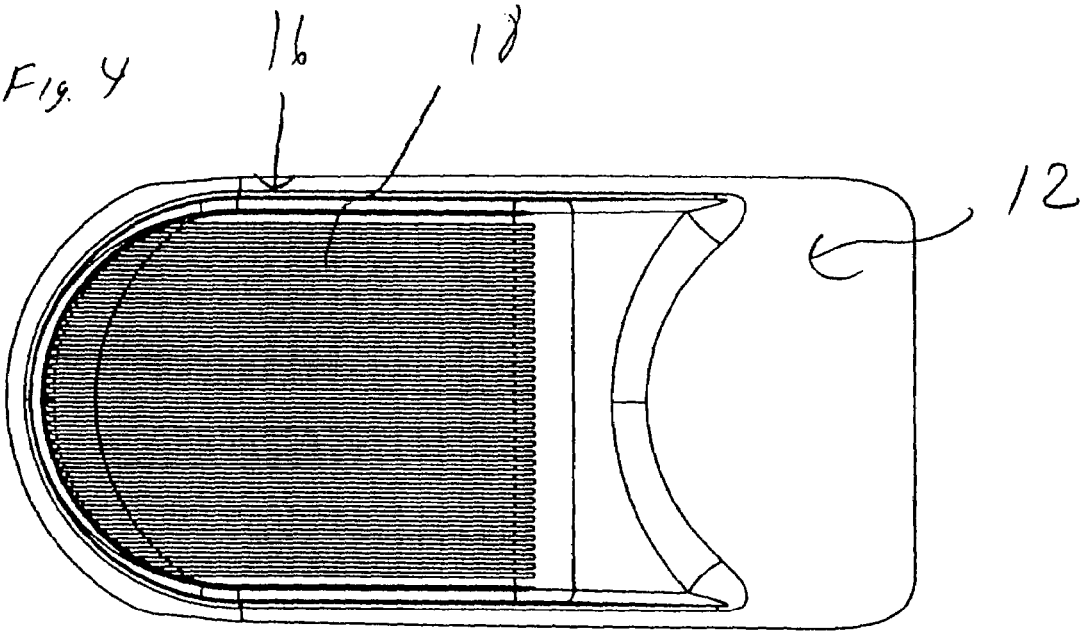
FIG. 4 is an underside plan view of the outer knee pad structure of FIG. 1.
Figure 5:
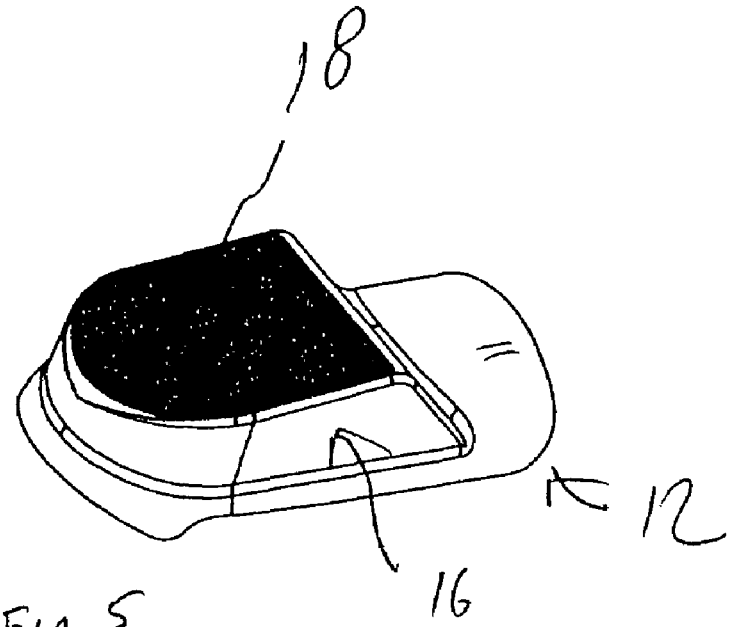
FIG. 5 is a underside perspective view of the outer knee pad structure of FIG. 1.
Figure 6:
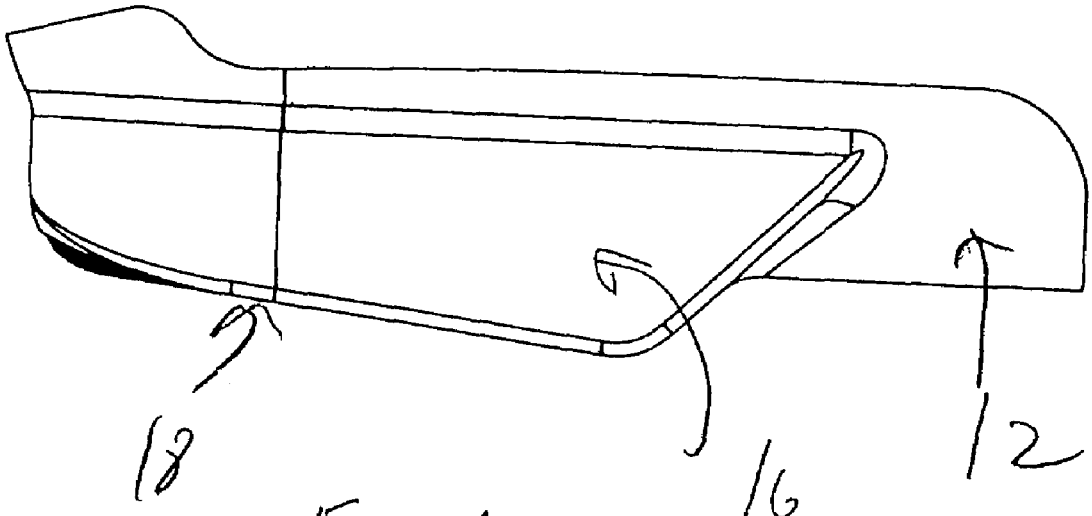
FIG. 6 is a side plan view of the outer knee pad structure of FIG. 1.
Figure 8:
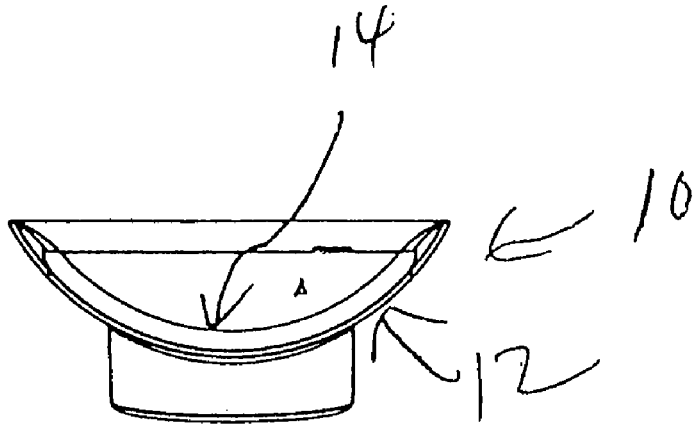
FIG. 8 is an end plan view of the exemplary knee pad assembly of FIG. 7.
Figure 7:
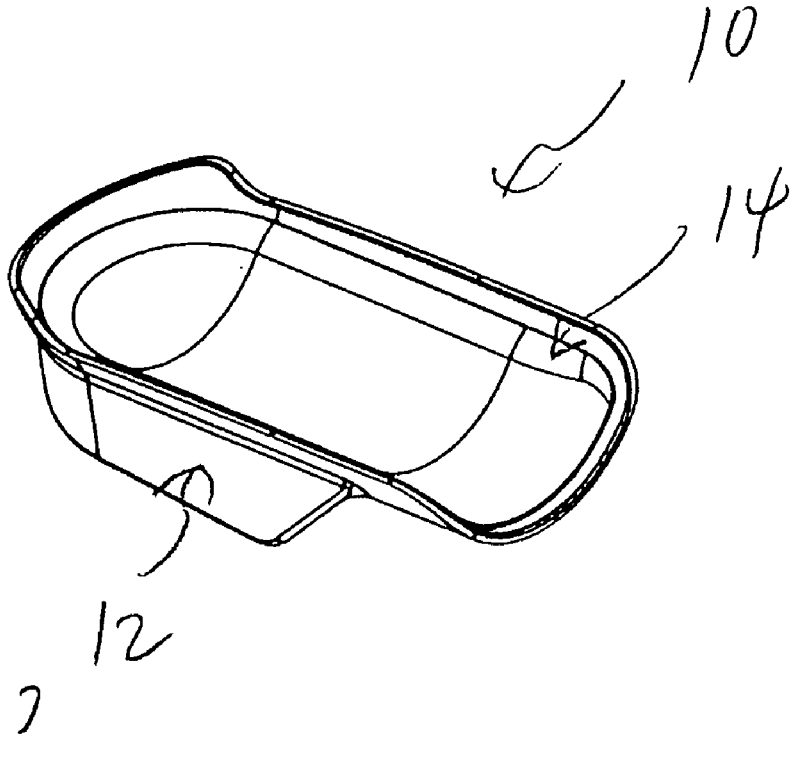
FIG. 7 is a top perspective view of an exemplary embodiment of the knee pad assembly of the present invention with the resilient foam inner knee and shin pad structure installed within the outer knee pad structure of FIG. 1.
Figure 9:
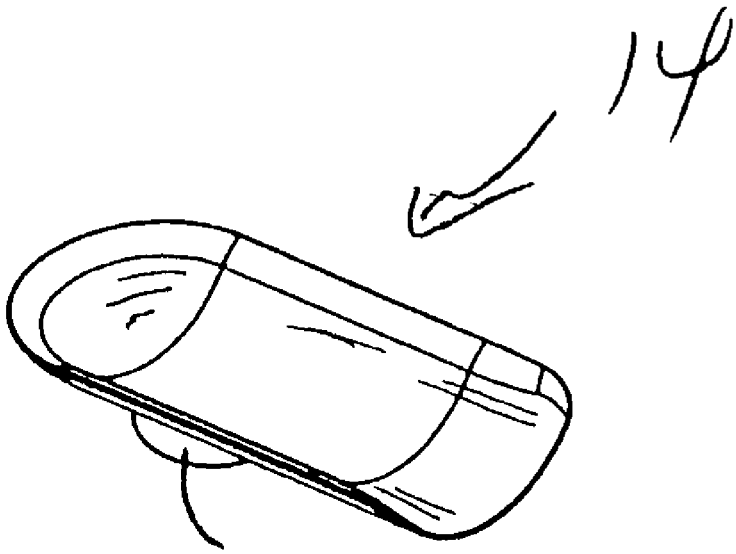
FIG. 9 is a top perspective view of the resilient foam inner knee and shin pad structure of FIG. 7 in isolation.
Figure 10:
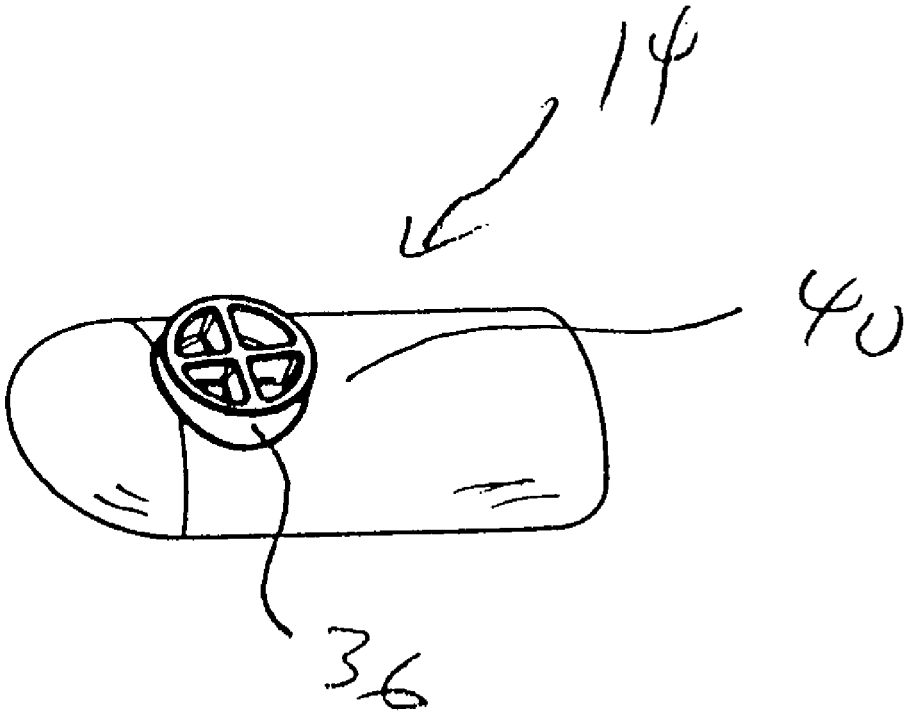
FIG. 10 is an underside perspective view of the resilient foam inner knee and shin pad structure of FIG. 7.
Figure 11:
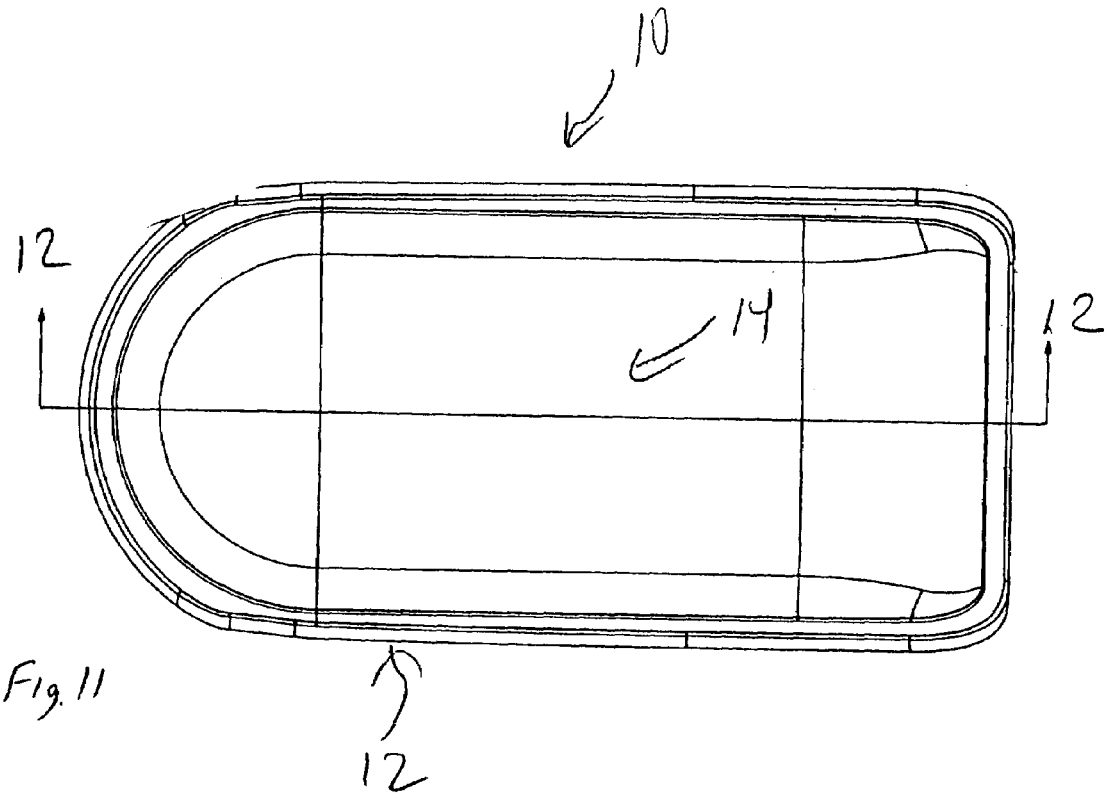
FIG. 11 is a top plan view of the exemplary knee pad assembly of FIG. 7.
Figure 12:
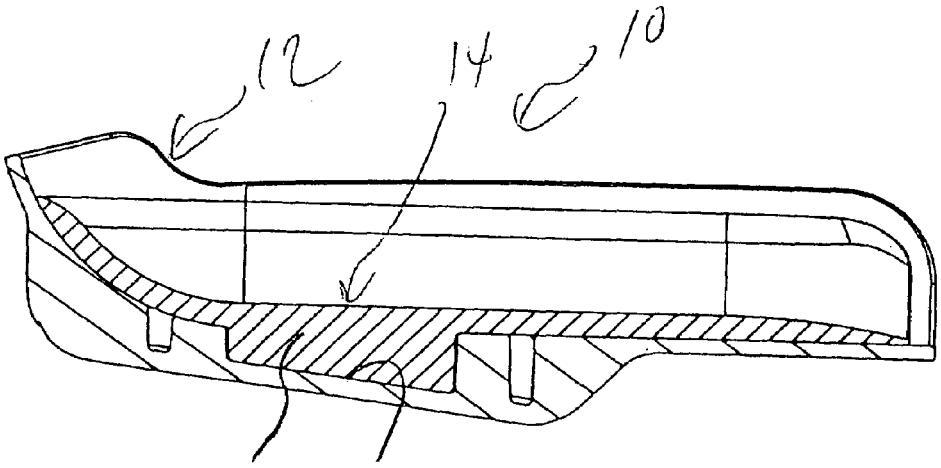
FIG. 12 is sectional view of the knee pad assembly of FIG. 7 along the line 12—12 of FIG. 11.

Outer knee pad structure 12 is molded of tough plastic and includes a bottom knee support plate, generally designated 16, having a non-slip bottom surface 18 and a top portion 20 integrally forming a knee and shin receiving structure 22 that defines an inner knee and shin pad receiving channel 24. Inner knee and shin pad receiving channel 24 is partially defined by a bottom channel surface 28 of knee and shin receiving structure 22 and includes a pad protrusion receiving cavity 30 formed therein. Pad protrusion receiving cavity 30 is cylindrical. As shown in FIGS. 1 and 2, first and second concentric cavities encircle central pad protrusion receiving cavity 30. The first concentric cavity is subdivided into at least four chambers, and the second concentric cavity is undivided and surrounds the first concentric cavity. A plurality of outer cavities (e.g., at least eight) extends longitudinally from the second concentric cavity. The outer cavities include at least four triangular cavities. More specifically, the illustrated embodiment includes a first plurality of four outer cavities adjacent a first side of the second concentric cavity, and a second plurality of four outer cavities adjacent to a second side of the second concentric cavity.

Resilient, molded foam inner knee and shin pad structure 14 is shaped to seat into the inner knee and shin pad receiving channel 22 and has a pad protrusion 36 extending from a bottom surface 40' thereof adapted to seat into the pad protrusion receiving cavity 30 of outer knee pad structure 12. Pad protrusion is embodied having a cylindrical shape.

It can be seen that a kneepad assembly has been provided.

It is noted that the embodiment of the kneepad assembly knee pads system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A knee pad assembly comprising:

a knee pad outer structure having a first and second side, said first side comprising a non-skid surface, and said second side comprising a central cavity and first and second concentric cavities encircling said central cavity; and a resilient knee pad inner structure comprising a protrusion positioned in said central cavity so that applying pressure to the knee pad assembly causes said protrusion within said central cavity to absorb the pressure, wherein said first concentric cavity is subdivided into at least four chambers, and said second concentric cavity is undivided and surrounds said first concentric cavity.

2. The knee pad assembly of claim 1 wherein said protrusion is cylindrical.

3. The knee pad assembly of claim 1 wherein said knee pad outer structure includes a bottom support plate.

4. The knee pad assembly of claim 1 wherein a plurality of outer cavities extends longitudinally from said second concentric cavity.

5. The knee pad assembly of claim 4 wherein said outer knee pad structure comprises at least eight of said outer cavities.

6. The knee pad assembly of claim 5 wherein said outer cavities include at least four triangular cavities.

7. The knee pad assembly of claim 6 wherein said outer cavities comprise a first plurality of four outer cavities adjacent a first side of said second concentric cavity, and a second plurality of four outer cavities adjacent to a second side of said second concentric cavity.

8. The knee pad assembly of claim 1 wherein said knee pad inner structure is integrally connected to said knee pad outer structure.

9. The knee pad assembly of claim 1 wherein said knee pad outer structure is comprised of plastic.

10. The knee pad assembly of claim 1 wherein said knee pad inner structure is comprised of resilient foam.

11. The knee pad assembly of claim 1 wherein said knee pad inner structure comprises an internal side and an external side, said internal side forming a channel for accommodating a knee and shin of a user.

12. The knee pad assembly of claim 1 wherein said central cavity is cylindrical.

* * * * *